United States Patent [19]

Dahl

[11] Patent Number: 4,891,232

[45] Date of Patent: Jan. 2, 1990

[54] BEVERAGE INFUSION DEVICE

[76] Inventor: Derek W. Dahl, 14641 NE. 35th St., Bellevue, Wash. 98007

[21] Appl. No.: 255,953

[22] Filed: Oct. 11, 1988

[51] Int. Cl.[4] ..... B65D 30/06; B65D 33/06

[52] U.S. Cl. ..... 426/78; 426/79; 426/82; 426/115; 426/110; 426/120

[58] Field of Search ..... 426/77–84, 426/112, 115, 110, 134, 132, 120

[56] References Cited

U.S. PATENT DOCUMENTS

| | | | |
|---|---|---|---|
| 489,468 | 1/1893 | Dillingham | 426/82 |
| 2,092,510 | 9/1937 | Haut | 426/82 |
| 2,123,054 | 7/1938 | Lamb et al. | 426/80 |
| 2,137,243 | 11/1938 | Heyman | 426/77 |
| 2,260,858 | 10/1941 | Naef | 426/82 |
| 2,285,113 | 6/1942 | Eaton | 426/80 |
| 2,291,278 | 7/1942 | Cleaves | 426/82 |
| 2,791,324 | 5/1957 | Knoup et al. | 426/79 |
| 2,791,505 | 5/1957 | Barnett | 426/83 |
| 3,154,418 | 10/1964 | Lovell et al. | 426/78 |
| 3,257,212 | 6/1966 | Kasket | 426/82 |
| 3,275,448 | 9/1966 | Sommer | 426/115 |
| 3,287,806 | 11/1966 | Kellerman | 426/110 |
| 3,326,363 | 6/1967 | Bennett et al. | 426/115 |
| 3,428,460 | 2/1969 | Ely | 426/115 |
| 3,469,997 | 9/1969 | Rossi et al. | 426/134 |
| 3,824,322 | 7/1974 | Fiorella | 426/134 |
| 3,869,555 | 3/1975 | Heonis | 426/134 |
| 4,215,628 | 8/1980 | Dodd | 426/82 |
| 4,338,338 | 7/1982 | Popkes | 426/82 |
| 4,410,550 | 10/1983 | Gaskill | 426/82 |
| 4,443,481 | 4/1984 | Donarumma et al. | 426/82 |
| 4,465,697 | 8/1984 | Brice et al. | 426/82 |
| 4,651,870 | 3/1987 | Giambalvo | 426/82 |
| 4,717,016 | 1/1988 | Dalgleish | 426/77 |

FOREIGN PATENT DOCUMENTS

| | | | |
|---|---|---|---|
| 655333 | 1/1963 | Canada | 426/110 |
| 0158511 | 10/1985 | European Pat. Off. | 426/82 |
| 1795868 | 9/1959 | Fed. Rep. of Germany | 426/82 |
| 2034709 | 1/1972 | Fed. Rep. of Germany | 426/77 |
| 3544263 | 6/1987 | Fed. Rep. of Germany | 426/77 |
| 500005 | 11/1954 | Italy | 426/110 |
| 1601335 | 10/1981 | United Kingdom | 426/77 |

*Primary Examiner*—Steven Weinstein
*Attorney, Agent, or Firm*—Leon Gilden

[57] ABSTRACT

A beverage infusion device is set forth wherein a packaged stirring-type stick includes an attached porous bag at one terminal end of the stick with infusion solid particulates contained within the bag. Positioned adjacent the bag about the body of the stick are a further series of infusion solid particulates selectively utilized by an individual with a removable wrapper about each particulate type whereupon removal of a wrapper enables selective flavor enhancing of the beverage.

1 Claim, 1 Drawing Sheet

BEVERAGE INFUSION DEVICE

BACKGROUND OF THE INVENTION

1. Field of the Invention

The present invention relates to beverage infusion and more particularly pertains to a new and improved beverage device further utilizing individually wrapped flavor enhancing components to selectively modify the beverage as desired.

2. Description of the Prior Art

The use of infusion devices and the like are well known in the prior art. Particularly in the prior art, particulates such as tea and coffee solids have been utilized in combination with stirring devices to effect a resultant beverage such as tea or coffee. For example, U.S. Pat. No. 4,215,628 to Dodd includes a stirring stick with a compartment at a lower terminal end of the stick for latchedly securing a porous bag therein for infusion into a liquid. The Dodd patent is typical of prior art devices of this class of invention limiting infusion to contents of a single porous bag.

U.S. Pat. No. 4,338,338 to Popkes sets forth a beverage strainer including a compartment for including a particulate food material for infusion into a liquid. The Popkes patent tends to eliminate the need for a porous bag by providing a porous face for enabling liquid flow therethrough.

U.S. Pat. No. 3,946,652 to Gorin sets forth a dispensing or brewing spoon including a hollow interior for containing a beverage-making ingredient for infusion into a liquid.

U.S. Pat. No. 4,314,724 to Barna sets forth a spring biased shell containing a "U" shaped depending handle to enable inclusion of various food materials therein for infusion into a liquid.

U.S. Pat. No. 790,626 to French includes a hollow tubular member including a pivoted porous end portion to accept a quantity of food material therein for infusion into a liquid.

As such, it may be appreciated that a new and improved beverage infusion device that enables the selective fusion of various ingredients into a liquid as heretofore been unavailable in the prior art and as such, the present invention substantially fulfills this need.

SUMMARY OF THE INVENTION

In view of the foregoing disadvantages inherent in the known types of infusion devices now present in the prior art, the present invention provides a beverage infusion device wherein the same comprises a planar stick including a depending porous bag integrally secured at a lower terminal end thereof containing a beverage forming ingredient and further including a plurality of removable strips adjacent said bag for selectively infusing various ingredients underlying the strips into the beverage. Typically, the porous bag contains tea or coffee, but may further include beverage making ingredients such as hot chocolate. The individually wrapped food solids contained in the strip containers above the porous bag may typically contain powdered milk, powdered lemon flavoring, sugar, etc., as flavor enhancing ingredients for a beverage provided for by the instant invention. As such, the general purpose of the present invention, which will be described susequently in greater detail, is to provide a new and improved beverage infusion device which has all the advantages of the prior art beverage devices and none of the disadvantages.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved beverage infusion device which has all the advantages of the prior art infusion devices and none of the disadvantages.

It is another object of the present invention to provide a new and improved beverage infusion device which may be easily and efficiently manufactured and marketed.

It is a further object of the present invention to provide a new and improved beverage infusion device which is of a durable and reliable construction.

An even further object of the present invention is to provide a new and improved beverage infusion device which is susceptible of a low cost of manufacture with regard to both materials and labor, and which accordingly is then susceptible of low prices of sale to the consuming public, thereby making such beverage infusion devices economically available to the buying public.

Still yet another object of the present invention is to provide a new and improved beverage infusion device which provides in the apparatuses and methods of the prior art some of the advantages thereof, while simultaneously overcoming some of the disadvantages normally associated therewith.

Still another object of the present invention is to provide a new and improved beverage infusion device that includes a beverage infusing porous bag and a plurality of beverage infusion ingredients positioned adjacent the bag for selectively imparting additional desired ingredients into a beverage.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
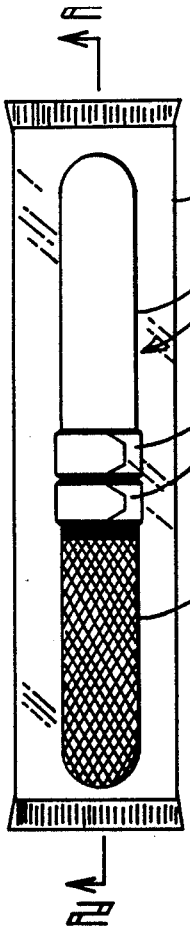
FIG. 1 is a top planar view of the instant invention.
Figure 2:
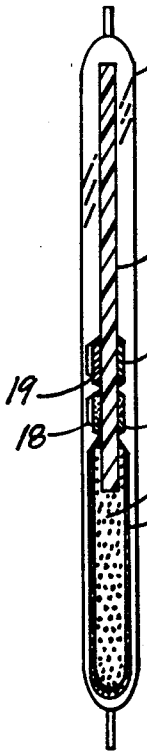
FIG. 2 is an orthographic view taken along the lines 2—2 of FIG. 2 in the direction indicated by the arrows.
Figure 3:
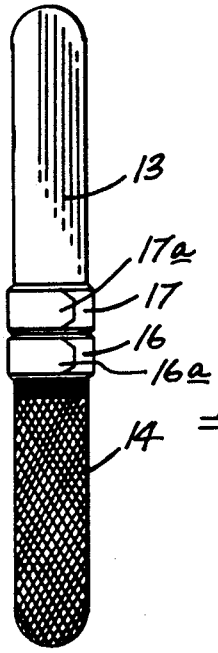
FIG. 3 is a top planar view of the instant invention removed from an associated wrapped container.
Figure 4:
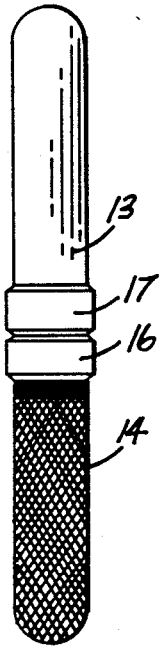
FIG. 4 is a rear orthographic plan view of the instant invention.

With reference now to the drawings, and in particular to FIGS. 1 to 4 thereof, a new and improved beverage infusion device embodying the principles and concepts of the present invention and generally designated by the reference numeral 10 will be described.

More specifically, the beverage infusion device 10 comprises a cellophane package 11 containing therein a planar infusion member 12. The infusion member 12 is generally of a planar rectangular cross-sectional configuration to provide a stirring surface to enhance agitation of the liquid that the infusion member is to mix. Secured proximate a lower terminal end of the infusion member 12 is a porous bag 14 that may be formed of a polymeric or paper-like material generally including the characteristic of a mesh size somewhat smaller than the included food stuffs therein. The food stuffs utilized in the instant invention generally include the group of coffee, tea, and cocoa-type infusion solids to be added to a liquid, such as water. While the bag is illustrated as of generally of a rectangular parallel pipet configuration, various shapes may be utilized and not depart from the scope of the instant invention. Positioned adjacent and immediately above the porous bag 14 is a first removable wrapper 16 and a second removable wrapper 17 adjacent the first removable wrapper including therewithin a respective first and second food additive 18 and 19. The food additives may include such ingredients as sugar, powdered milk, powdered lemon, etc., to complement the infusion solids 15 within the porous bag 14. In this manner, a user of the instant invention may tailor a beverage to a particular liking and may thereby selectively utilize or not utilize the food additives 18 and 19, as desired. While two removable wrappers 16 and 17 are illustrated, it is to be understood that a series of such may be utilized in understandably maintaining a portion of the planar infusion 13 to enable comfortable and convenient gripping thereof by a user.

The removable wrappers 16 and 17 are provided with tapered terminal gripping ends 16*a* and 17*a* respectively to enable ease of grasping of the wrappers 16 and 17.

As to the manner of usage and operation of the instant invention, the same should be apparent from the above description and accordingly no further discussion relative to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A beverage infusion device comprising in combination, a hand-held, elongate planar rigid stirring member of a constant cross-sectional configuration to enhance agitation of an infusion liquid, said stirring member having first and second opposed terminal ends, and an elongate liquid permeable bag integrally secured to said stirring member proximate said first terminal end of said stirring member, said bag containing beverage infusable solids therein, said porous bag extending below and in longitudinal alignment with said stirring member, and wherein a first removable wrapper is wrapped transversely around said stirring member and encompasses a first food additive compatible with said beverage infusion solids, which first food additive encompasses said stirring member thereunder such that upon removal of said wrapper, said first food additive is releasable into an infusion liquid, and wherein an additional removable wrapper is wrapped transversely around said stirring member and is positioned adjacent to but separate from said first removable wrapper and encompasses a second food additive compatible with said beverage infusion solids, which second food additive encompasses said stirring member thereunder such that upon removal of said additional wrapper, said second food additive is separately releasable from said first additive into an infusion liquid, said first and additional removable wrappers being provided with gripping means to enable ease of gripping said first and additional wrappers and wherein said first and additional removable wrappers are positioned adjacent each other but spaced from said terminal end sufficient to provide a gripping surface on said stirring member when used to make a beverage and wherein said first removable wrapper is positioned adjacent said porous bag on said infusion device.

* * * * *